US009867752B2

(12) United States Patent
Wang

(10) Patent No.: US 9,867,752 B2
(45) Date of Patent: Jan. 16, 2018

(54) TILTING INVERSION EXERCISER

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 15 days.

(21) Appl. No.: 15/047,664

(22) Filed: Feb. 19, 2016

(65) Prior Publication Data

US 2017/0239123 A1 Aug. 24, 2017

(51) Int. Cl.

| | |
|---|---|
| ***A63B 26/00*** | (2006.01) |
| ***A61H 1/00*** | (2006.01) |
| *A61H 1/02* | (2006.01) |

(52) U.S. Cl.

CPC ..... *A61H 1/003* (2013.01); *A61H 1/0218* (2013.01); *A61H 1/0222* (2013.01); *A61H 1/0229* (2013.01); *A61H 2203/0431* (2013.01)

(58) Field of Classification Search

CPC .... A61H 1/0222; A61H 1/0229; A61H 1/003; A61H 1/0218; A63B 23/02; A63B 23/0205; A63B 23/0222; A63B 23/0233; A63B 23/0238; A63B 2208/0285; A63B 21/068

See application file for complete search history.

(56) References Cited

U.S. PATENT DOCUMENTS

| | | | | |
|---|---|---|---|---|
| 3,075,518 | A * | 1/1963 | Sellner | A61H 1/0292 482/142 |
| 3,378,259 | A * | 4/1968 | Kupchinski | A63B 23/03575 297/29 |
| 4,531,731 | A * | 7/1985 | Law | A61H 1/0218 482/144 |
| 5,217,487 | A * | 6/1993 | Engel | A61H 1/0292 482/142 |
| 5,664,042 | A * | 9/1997 | Kennedy | G02B 6/4298 385/134 |
| 5,967,956 | A * | 10/1999 | Teeter | A61H 1/003 482/144 |
| 6,443,879 | B1 * | 9/2002 | Chen | A61H 1/0218 482/143 |
| 7,063,652 | B1 | 6/2006 | Teeter et al. | |
| 7,081,073 | B1 | 7/2006 | Smith | |
| 7,112,167 | B2 | 9/2006 | Kim | |
| 7,118,518 | B1 | 10/2006 | Teeter | |
| 7,125,372 | B1 | 10/2006 | Teeter et al. | |
| 7,374,521 | B2 | 5/2008 | Wang | |
| 7,507,192 | B2 | 3/2009 | Teeter et al. | |

(Continued)

*Primary Examiner* — Nyca T Nguyen
(74) *Attorney, Agent, or Firm* — Charles E. Baxley

(57) ABSTRACT

A tilting inversion exerciser includes a supporting stand having a primary frame and an auxiliary frame, one or two carriers pivotally attached to the supporting stand with apex members, a supporting table attached to the carriers and movable relative to the carriers, the carrier includes a guiding device for guiding the supporting table to move relative to the carrier and the apex member, and a spring biasing member is engaged between the carrier and the supporting table for adjusting a center of gravity of the carrier relative to the supporting table when users of different weight is engaged onto the supporting table and for giving some security to the user while conducting the inversion exercises.

5 Claims, 13 Drawing Sheets

(56) References Cited

U.S. PATENT DOCUMENTS

| | | | | |
|---|---|---|---|---|
| 7,544,157 | B2 | 6/2009 | Teeter et al. | |
| 7,585,264 | B1 * | 9/2009 | Wang | A61H 1/0218 482/144 |
| 7,625,327 | B1 | 12/2009 | Teeter et al. | |
| 7,699,763 | B2 * | 4/2010 | Perry, Jr. | A61H 1/0218 482/142 |
| 7,867,154 | B2 | 1/2011 | Teeter et al. | |
| 9,327,163 | B2 * | 5/2016 | Lin | A63B 22/0605 |
| 2003/0017922 | A1 * | 1/2003 | Sachs | A63B 69/0093 482/146 |
| 2007/0038161 | A1 * | 2/2007 | Bonutti | A61F 5/0102 601/5 |
| 2008/0261791 | A1 * | 10/2008 | Chen | A61H 1/0218 482/144 |

* cited by examiner

TILTING INVERSION EXERCISER

BACKGROUND OF THE INVENTION

1. Field of the Invention

The present invention relates to a tilting inversion exerciser, and more particularly to a tilting inversion exerciser including an adjustable structure or configuration for adjusting the user supporting table to a suitable or selected position relative to the lower or base support or supporting stand automatically and for suitably and safely supporting the user and for giving some security to the user while conducting the inversion exercises.

2. Description of the Prior Art

Various kinds of typical inversion suspension exercisers, rotational exercisers, tilting inversion exercisers etc. have been developed and comprise a user supporting table rotatably or pivotally attached to an upper portion of a lower or base support or supporting stand with a pivot axle, and rotatable relative to the base support for conducting or operating various inversion or suspension exercises.

For example, U.S. Pat. No. 7,063,652 to Teeter et al., U.S. Pat. No. 7,081,073 to Smith, U.S. Pat. No. 7,112,167 to Kim, U.S. Pat. No. 7,118,518 to Teeter, U.S. Pat. No. 7,125,372 to Teeter et al., U.S. Pat. No. 7,374,521 to Wang, U.S. Pat. No. 7,507,192 to Teeter et al., U.S. Pat. No. 7,544,157 to Teeter et al., and U.S. Pat. No. 7,867,154 to Teeter et al. disclose several of the typical inversion suspension exercisers each comprising a user supporting table rotatably or pivotally attached to a base support or supporting stand and arranged for allowing the users to pivot or rotate the table relative to the base support, and to do various inversion or suspension exercises.

However, the user has to spend a lot of force and energy to rotate and to hold and maintain the user supporting table at the selected angular position relative to the lower supporting stand, and the user supporting table may not be adjusted relative to the base support according to different sizes or weights or dimensions of the user such that the user may not easily and comfortably actuate or operate the typical inversion suspension exerciser.

U.S. Pat. No. 7,585,264 to Wang et al., and U.S. Pat. No. 7,625,327 to Teeter et al. disclose the other typical inversion suspension exercisers each also comprising a user supporting table rotatably or pivotally attached to a base support or supporting stand, and an adjustable structure or configuration for adjusting the user supporting table to a suitable or selected position relative to the lower or base support or supporting stand and for allowing the users to easily and comfortably actuate or operate the typical inversion suspension exerciser.

However, the typical inversion suspension exercisers include a complicated adjustable structure or configuration that may not be easily and quickly made or manufactured by the workers, and/or that may include a complicated making or manufacturing procedure, such that the typical inversion suspension exerciser may include a greatly increased manufacturing cost.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including an adjustable structure or configuration for adjusting the user supporting table to a suitable or selected position relative to the lower or base support or supporting stand automatically and for suitably and safely supporting the user and for giving some security to the user while conducting the inversion exercises.

In accordance with one aspect of the invention, there is provided a tilting inversion exerciser comprising a supporting stand including a primary frame and an auxiliary frame pivotally coupled together to form an inverted V-shaped structure, one or two carriers pivotally attached to the supporting stand with apex members, a supporting table attached to the carriers and movable relative to the carriers, the carriers each include a guiding device for guiding the supporting table to move relative to the carriers and the apex members, and a spring biasing member is engaged between the carriers and the supporting table for adjusting a center of gravity of the carrier relative to the supporting table when users of different weight is engaged onto the supporting table, and for allowing the center of gravity of the carrier and the user relative to the supporting table to be suitably lowered when a relatively heavier user is engaged onto the supporting table, and to be suitably elevated when a relatively lighter user is engaged onto the supporting table.

The guiding device of the carrier includes at least one groove formed therein, and the groove of the carrier includes a first end portion located closer to the apex member than a second end portion of the groove of the carrier, and the supporting table includes at least one follower slidably engaged with the groove of the carrier for guiding and limiting the follower and the supporting table to move and to be adjusted relative to the carrier and the supporting stand.

The groove of the carrier is preferably inclined relative to a base axis (X) of the carrier which is offset from the apex member for a predetermined distance and which is tangent to the apex member. The supporting table includes an arm rest engaged with the spring biasing member which is thus be engaged between the carrier and the supporting table, and the follower is attached to the arm rest and slidably engaged with the groove of the carrier.

The carrier includes a flap extended from a bracket for engaging with and for supporting the spring biasing member. The primary frame and the auxiliary frame of the supporting table are pivotally coupled together with the apex member for allowing the frames to be folded and supported between an opened working position and a folded or compact storing position wherein the frames of the supporting stand are folded and contacted or engaged with each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
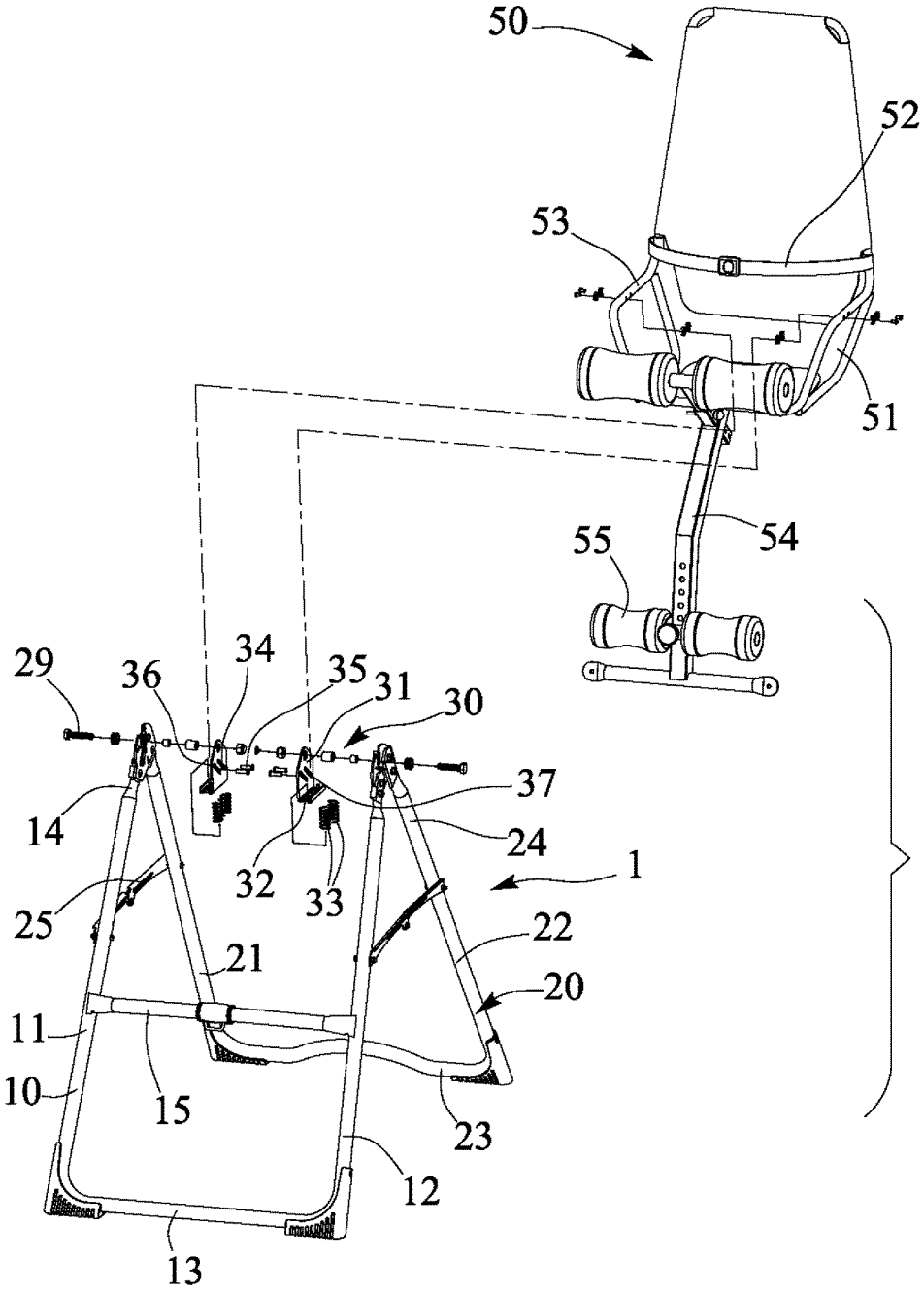
FIG. 1 is a partial exploded view of a tilting inversion exerciser in accordance with the present invention.
Figure 2:
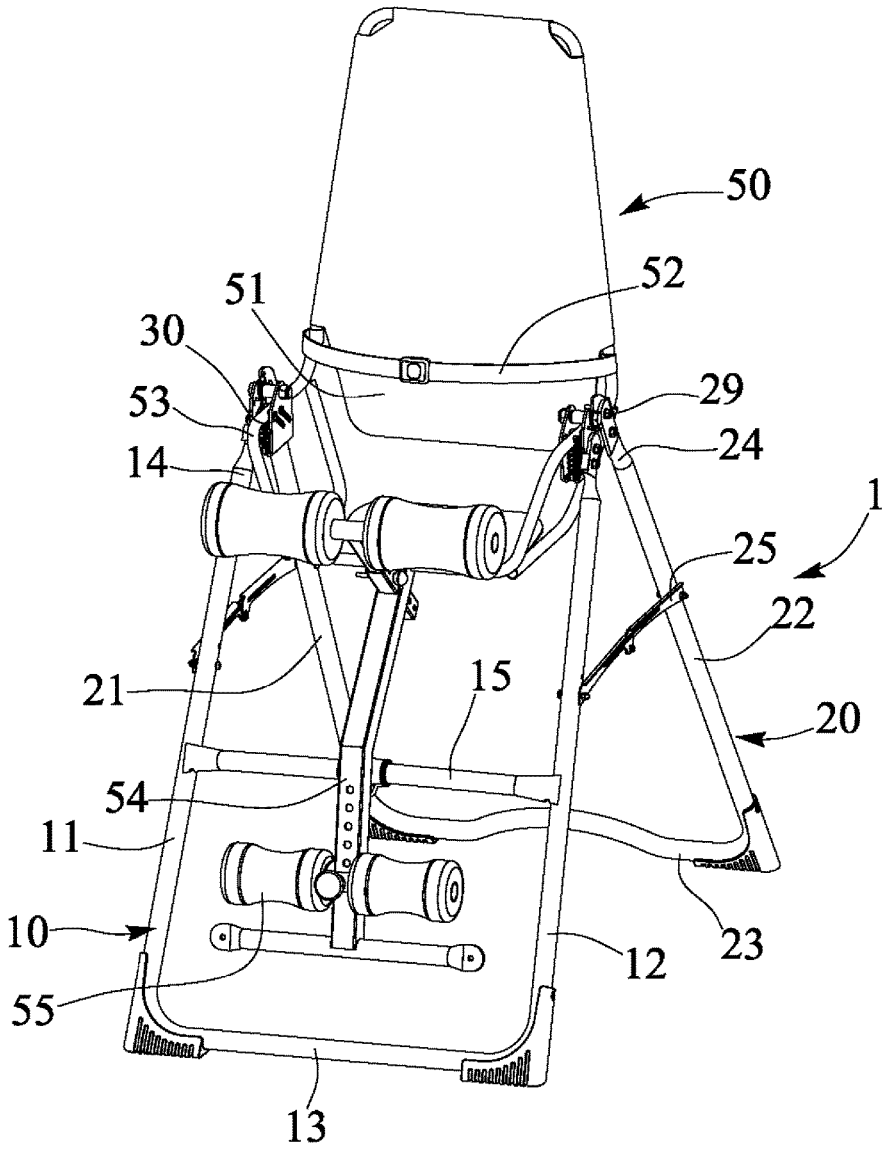
FIG. 2 is a perspective view of the tilting inversion exerciser.

Referring to the drawings, and initially to FIGS. 1-9, a tilting inversion exerciser in accordance with the present invention comprises a lower supporting stand 1 for pivotally or rotatably supporting a base or seat or table 50 thereon, and for supporting a user 8 (FIGS. 4-6) on the supporting table 50, the lower supporting stand 1 includes two U-shaped frames 10, 20, such as a front or primary U-shaped frame 10 and a rear or auxiliary U-shaped U-shaped frame 20 having upper ends pivotally coupled together with two pivot spindles or apex members 29 so as to form a substantially inverted V-shaped structure (FIGS. 1-6 and 10-14), and for allowing the frames 10, 20 of the supporting stand 1 to be folded and supported between an opened working position (FIGS. 1-6 and 10-14) and a folded or compact storing position (not illustrated) wherein the frames 10, 20 of the supporting stand 1 are folded and contacted or engaged with each other.

The primary U-shaped frame 10 of the lower supporting stand 1 includes two, such as first and second side posts 11, 12 and a lower beam 13 formed or provided or coupled between the side posts 11, 12 for forming or defining the U-shaped structure of the primary frame 10, the apex members 29 are disposed or attached or mounted or secured to the upper portions 14 of the side posts 11, 12 of the primary frame 10 respectively. The rear U-shaped frame 20 also includes two side posts 21, 22 and a lower beam 23 formed or provided or coupled between the posts 21, 22 for forming or defining the U-shaped structure of the rear frame 20, the upper portions 24 of the posts 21, 22 of the rear frame 20 are pivotally or rotatably attached or mounted or secured or coupled to the upper portions 14 of the posts 11, 12 of the primary frame 10 with the apex members 29 respectively (FIGS. 1-2) for allowing the rear frame 20 to be folded or moved toward the primary frame 10 to the folded or compact storing position, and to be opened or moved away from the primary frame 10 to the opened working position as shown in FIGS. 1-6 and 10-14.

One or more (such as two) foldable links 25 may further be provided and attached or mounted or secured or coupled between the frames 10, 20 for coupling the frames 10, 20 together and for solidly and stably anchoring or securing or retaining the frames 10, 20 at the opened working position and for preventing the frames 10, 20 from being over-opened relative to each other. The supporting table 50 may include or may be formed into a seat-shaped structure or configuration for suitably and safely and comfortably supporting the user 8 thereon, and may include a seat member 51 for supporting the user 8 thereon, and may include a seat belt 52 for solidly and tightly and stably anchoring or securing or retaining the user 8 on the seat member 51 of the supporting table 50, and may include one or more (such as two) arm rests 53 formed or provided thereon for being grasped or held by the user 8.

The supporting table 50 or the seat member 51 includes an extension 54, such as an adjustable extension 54 attached or coupled or extended from the supporting table 50 and/or the seat member 51 for supporting an ankle holder or foot retaining device 55 and for holding or retaining or positioning the feet of the user 8 to the seat member 51 and the supporting table 50. The extension 54 may be extended or adjusted relative to the supporting table 50 for moving or adjusting the foot retaining device 55 toward or away from the supporting table 50, according to the height or the dimension of the users, for example. The primary frame 10 further include a reinforcing bar 15 disposed or attached or mounted or secured between the posts 11, 12 of the primary frame 10 for reinforcing the primary frame 10, and for contacting or engaging with the extension 54 and for limiting the extension 54 and the supporting table 50 to pivot or rotate relative to the supporting stand 1.

The above-described structure or configuration for the tilting inversion exerciser, including the lower supporting stand 1, the seat member 51 and the extension 54 and the foot retaining device 55 and the supporting table 50 is typical and is not related to the present invention and will not be described in further details. The lower supporting stand 1 includes one or more, such as two carriers 30 pivotally or rotatably attached or mounted or secured or coupled to the supporting stand 1, the carriers 30 each include a plate or frame or bracket 31 pivotally or rotatably attached or mounted or secured or coupled to the upper portions 14 of the side posts 11, 12 of the primary frame 10 or the upper portions 24 of the posts 21, 22 of the rear frame 20 respectively of the supporting stand 1 with the apex members 29 for engaging with and for attaching or mounting or securing or supporting the supporting table 50 to the supporting stand 1.

The brackets 31 of the carriers 30 each include a frame or flap 32 laterally extended therefrom for supporting one or more, such as two spring biasing members 33, and each include one or more, such as two oblong holes or grooves 34 formed therein and substantially tilted or inclined relative to a base axis (X) of the bracket 31 of the carrier 30 that is offset or spaced or separated from the apex members 29 for a selected or predetermined distance (FIGS. 7-9), but tangent to the apex members 29, and the grooves 34 of the carriers 30 are located beside the spring biasing members 33 respectively. The seat member 51 of the supporting table 50 includes one or more, such as two guiding pins or followers 35 attached or mounted or secured to each of the arm rests 53 of the seat member 51 of the supporting table 50 and moved in concert with the seat member 51 of the supporting table 50 and slidably engaged in the grooves 34 of the respective carrier 30 respectively.

As best shown in FIGS. 3-9, the guiding pins or followers 35 are slidably received or engaged in the grooves 34 of the respective carrier 30 respectively for guiding and limiting the followers 35 and thus the seat member 51 of the supporting table 50 to move or slide relative to the carrier 30 and/or the supporting stand 1. The spring biasing members 33 are disposed and contacted or engaged with the arm rests 53 of the seat member 51 of the supporting table 50 and also contacted or engaged with the flap 32 of the bracket 31 of the carrier 30, and are thus engaged between the supporting table 50 and the carrier 30 and/or the supporting stand 1 for applying a spring biasing force between the supporting table 50 and the carrier 30 and/or the supporting stand 1 and thus for balancing the supporting table 50 relative to the carrier 30 and/or the supporting stand 1.

Figure 3:
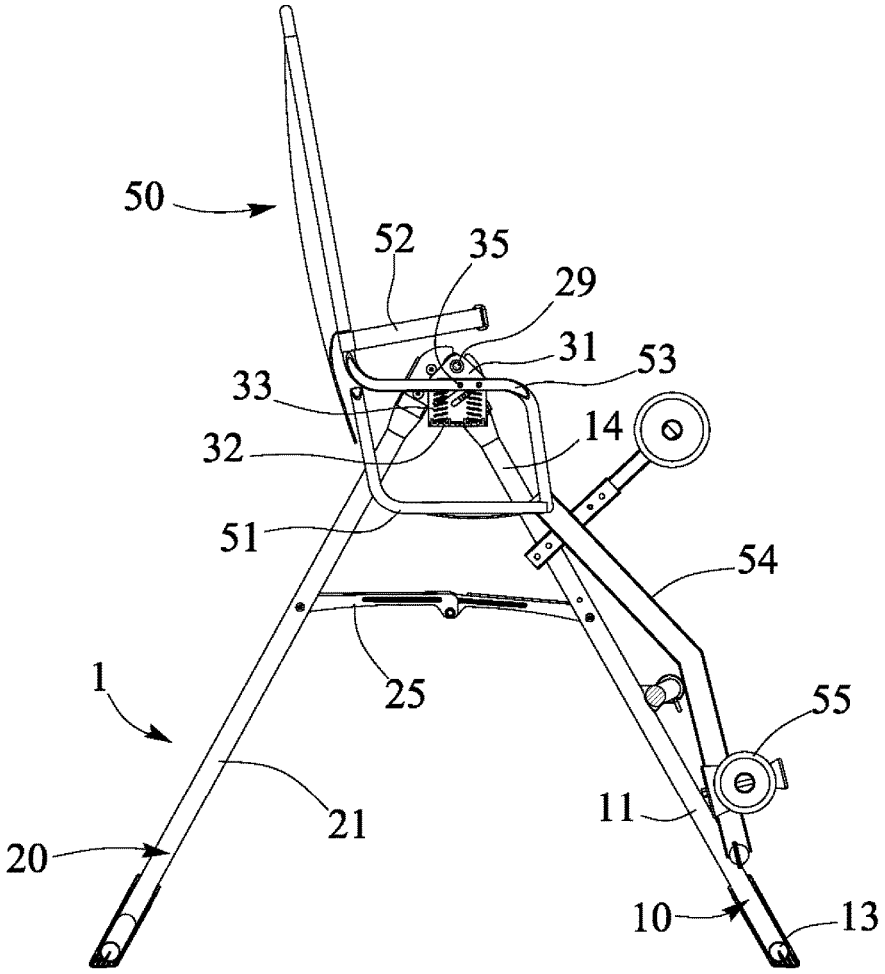
FIG. 3 is a side plan schematic view of the tilting inversion exerciser.
Figure 6:
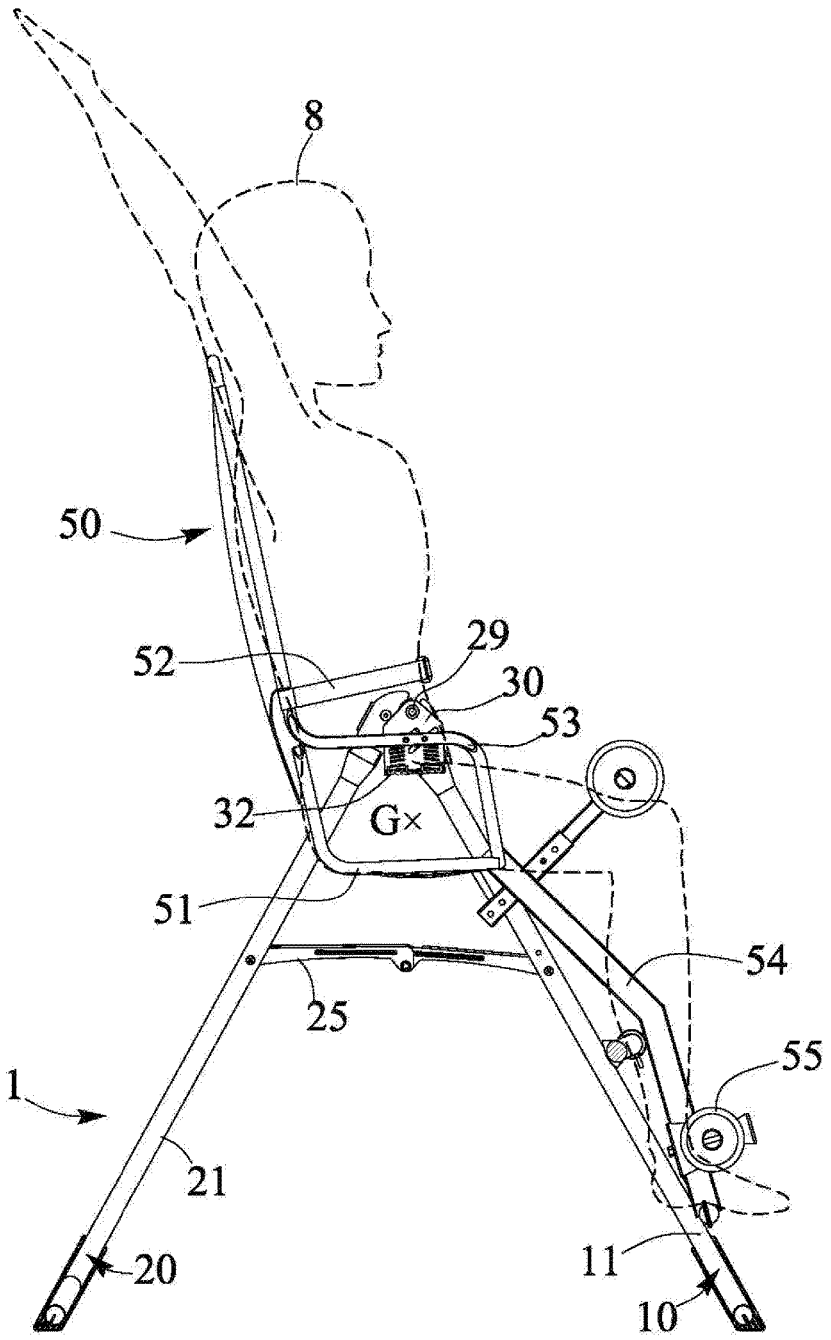
Figure 7:
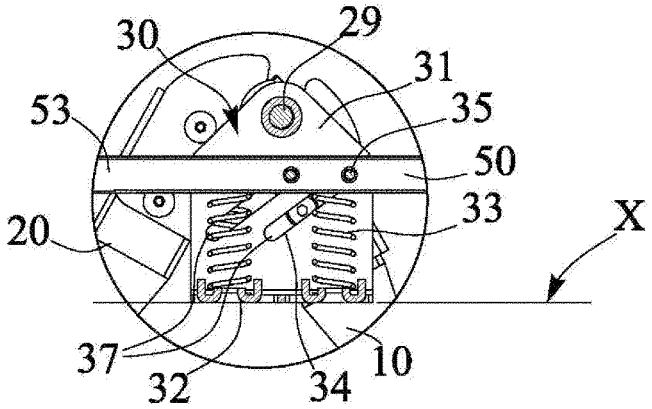
FIGS. 7, 8, 9 are enlarged partial cross sectional views of the tilting inversion exerciser as shown in FIGS. 3, 4, and 6 respectively.
Figure 9:
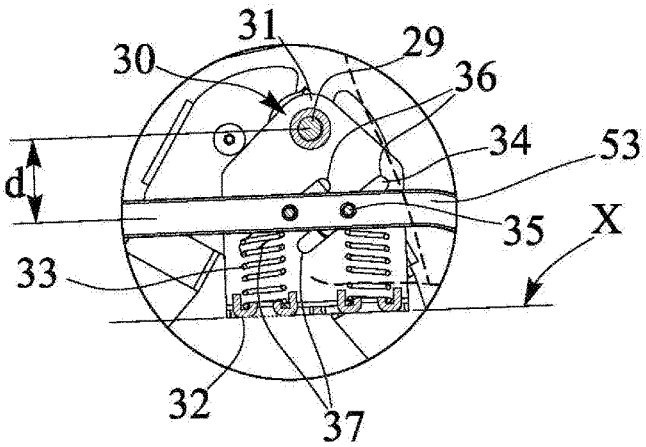
Figure 10:
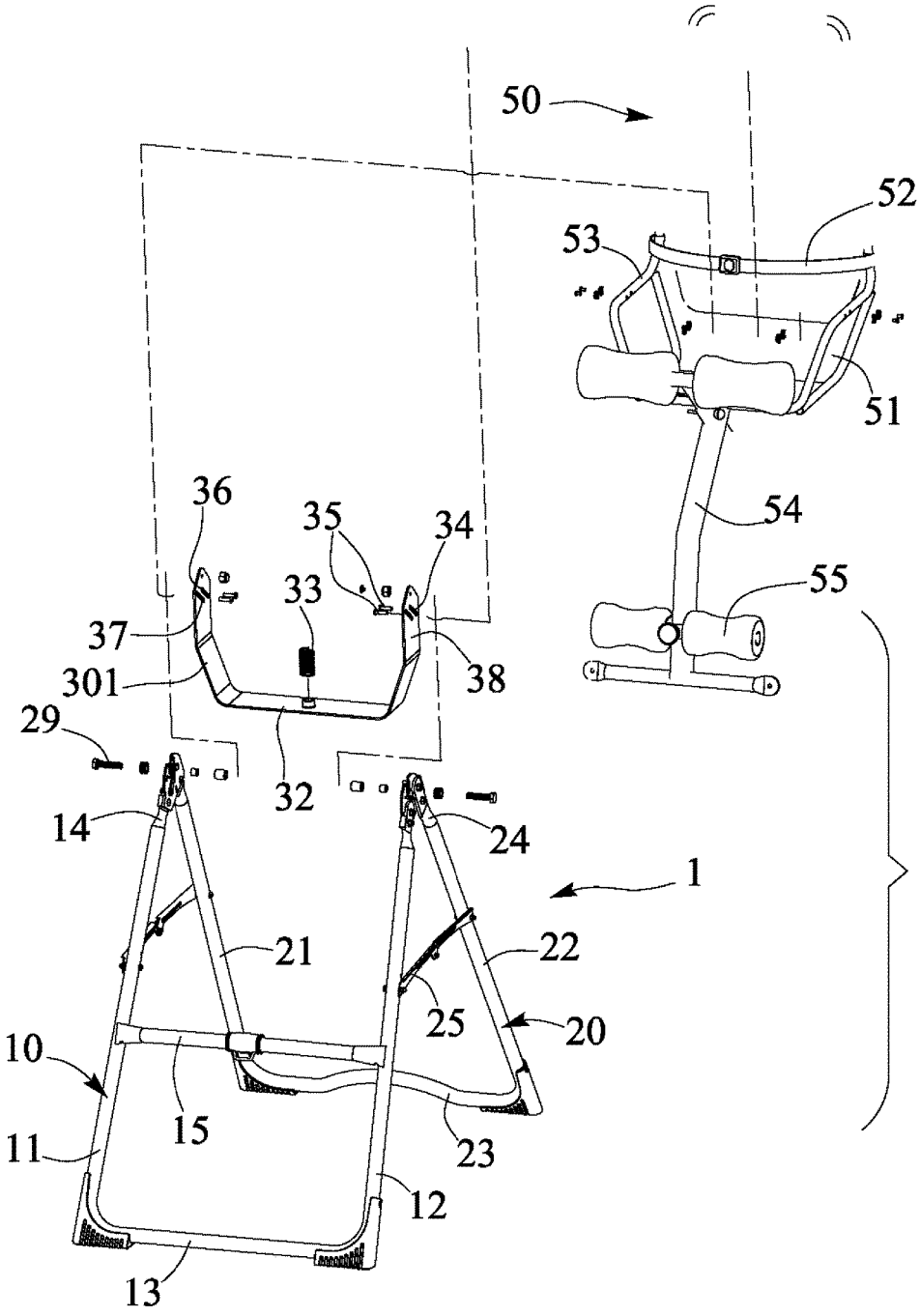
FIG. 10 is another partial exploded view similar to FIG. 1, illustrating the other arrangement of the tilting inversion exerciser.
Figure 11:
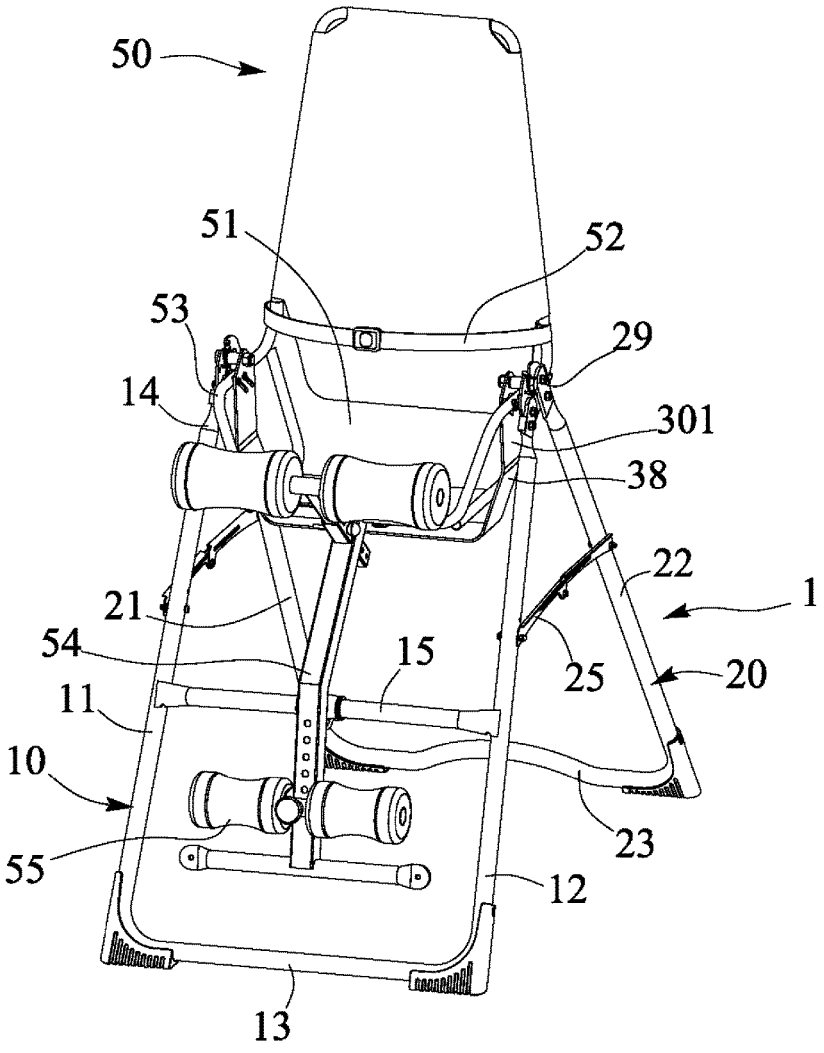
FIG. 11 is a perspective view of the tilting inversion exerciser as shown in FIG. 10.
Figure 12:
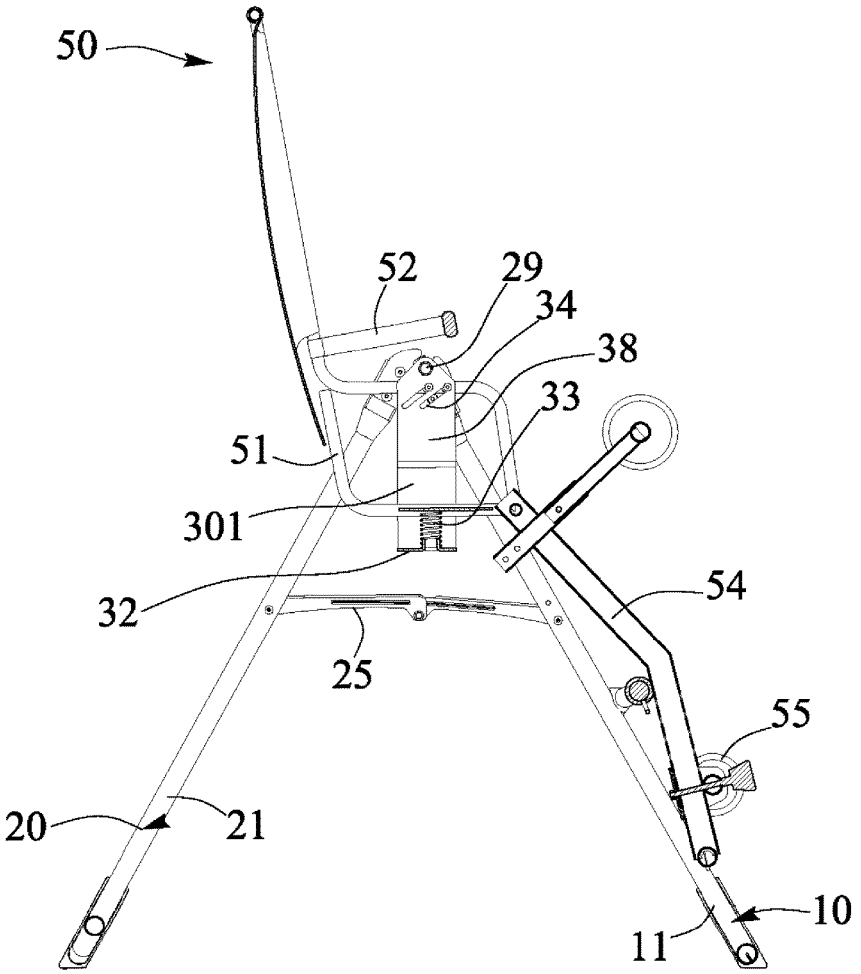
FIGS. 12, 13, 14 are side plan schematic views of the tilting inversion exerciser as shown in FIGS. 10-11, illustrating the operation of the tilting inversion exerciser.
Figure 13:
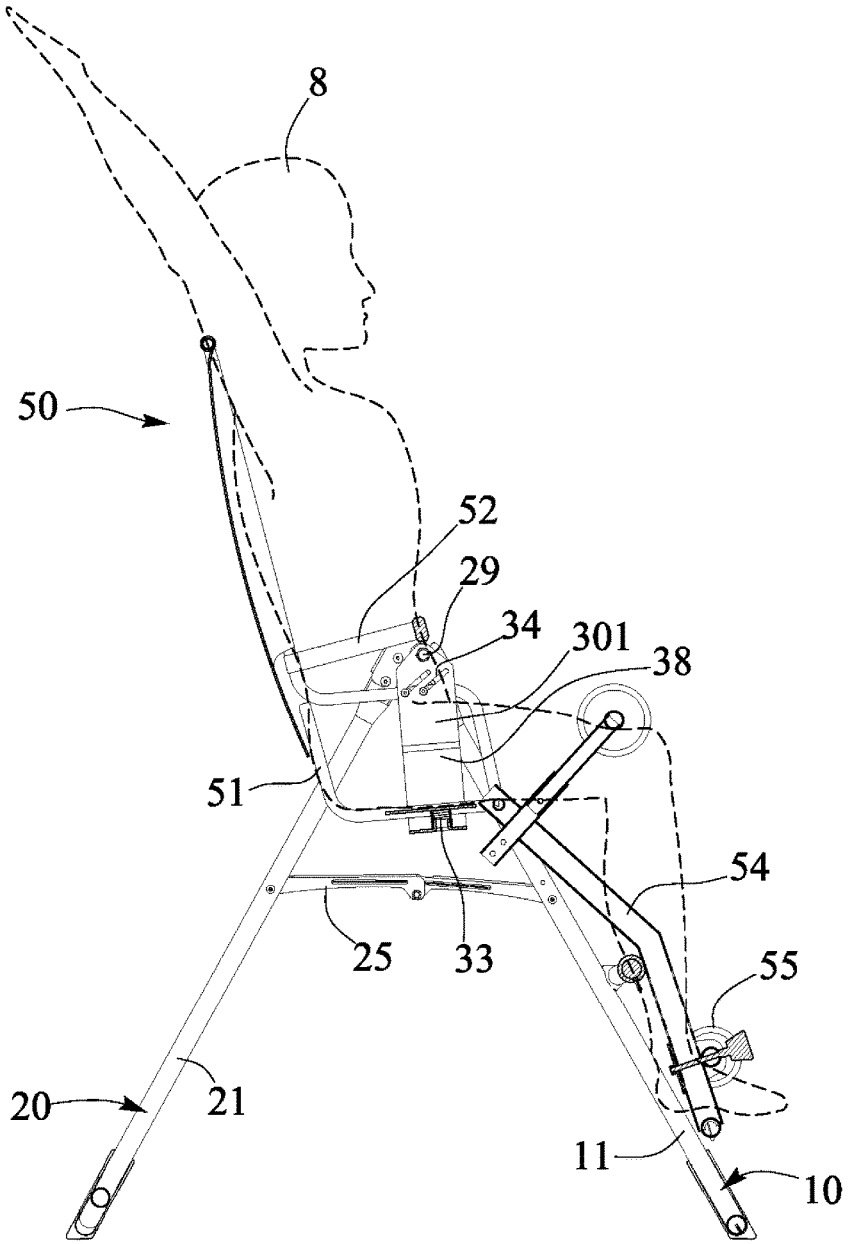
Figure 14:
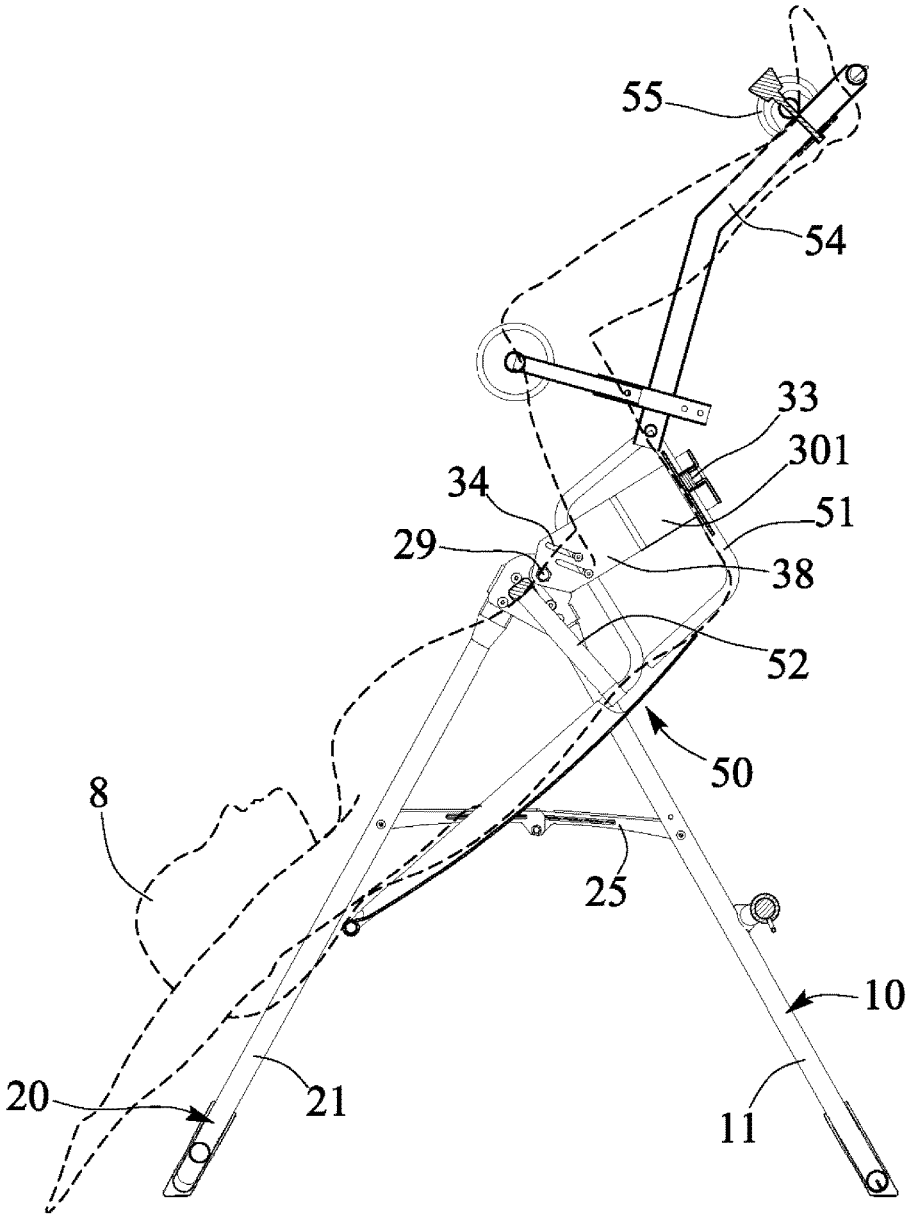
Figure 15:
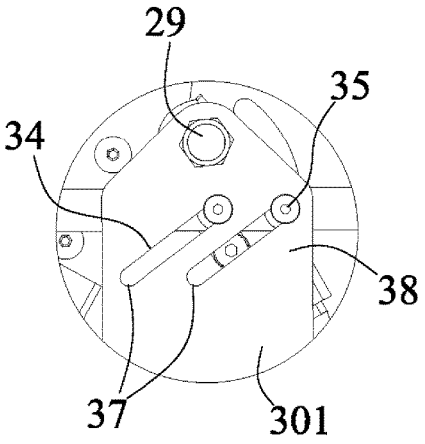
FIGS. 15, 16 are enlarged partial cross sectional views of the tilting inversion exerciser as shown in FIG. 12.
Figure 16:
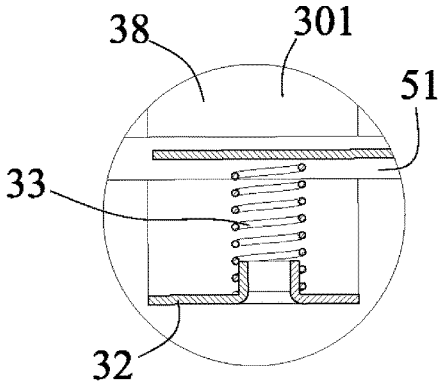
Figure 17:
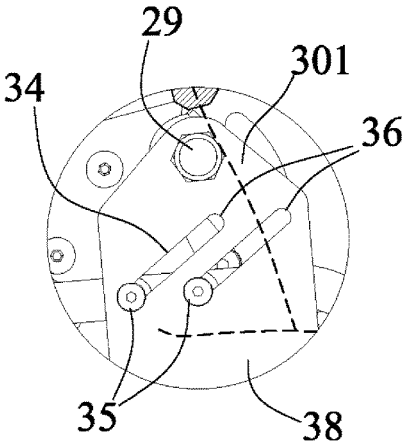
FIGS. 17, 18 are enlarged partial cross sectional views of the tilting inversion exerciser as shown in FIG. 13.
Figure 18:
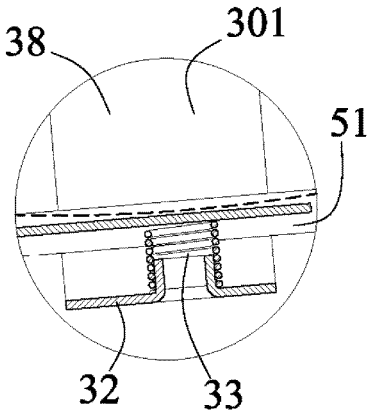

In operation, as shown in FIGS. 3 and 7, when no user is seated on the seat member 51 of the supporting table 50, the spring biasing members 33 may apply the spring biasing force to force and move the arm rests 53 of the seat member 51 of the supporting table 50 away from the flap 32 of the bracket 31 of the carrier 30, and toward the apex member 29, and the followers 35 may be moved toward one or first end portion 36 of the grooves 34 of the carrier 30. As shown in FIGS. 6 and 9, when a relatively light weight user 8 is seated on the seat member 51 of the supporting table 50, the spring biasing members 33 may be slightly depressed by the arm rests 53 of the seat member 51 of the supporting table 50, and the followers 35 may be moved away from the one or first end portion 36 of the grooves 34 of the carrier 30, and toward the other or second end portion 37 of the grooves 34 of the carrier 30, at a predetermined distance (d) away from the apex member 29.

Figure 4:
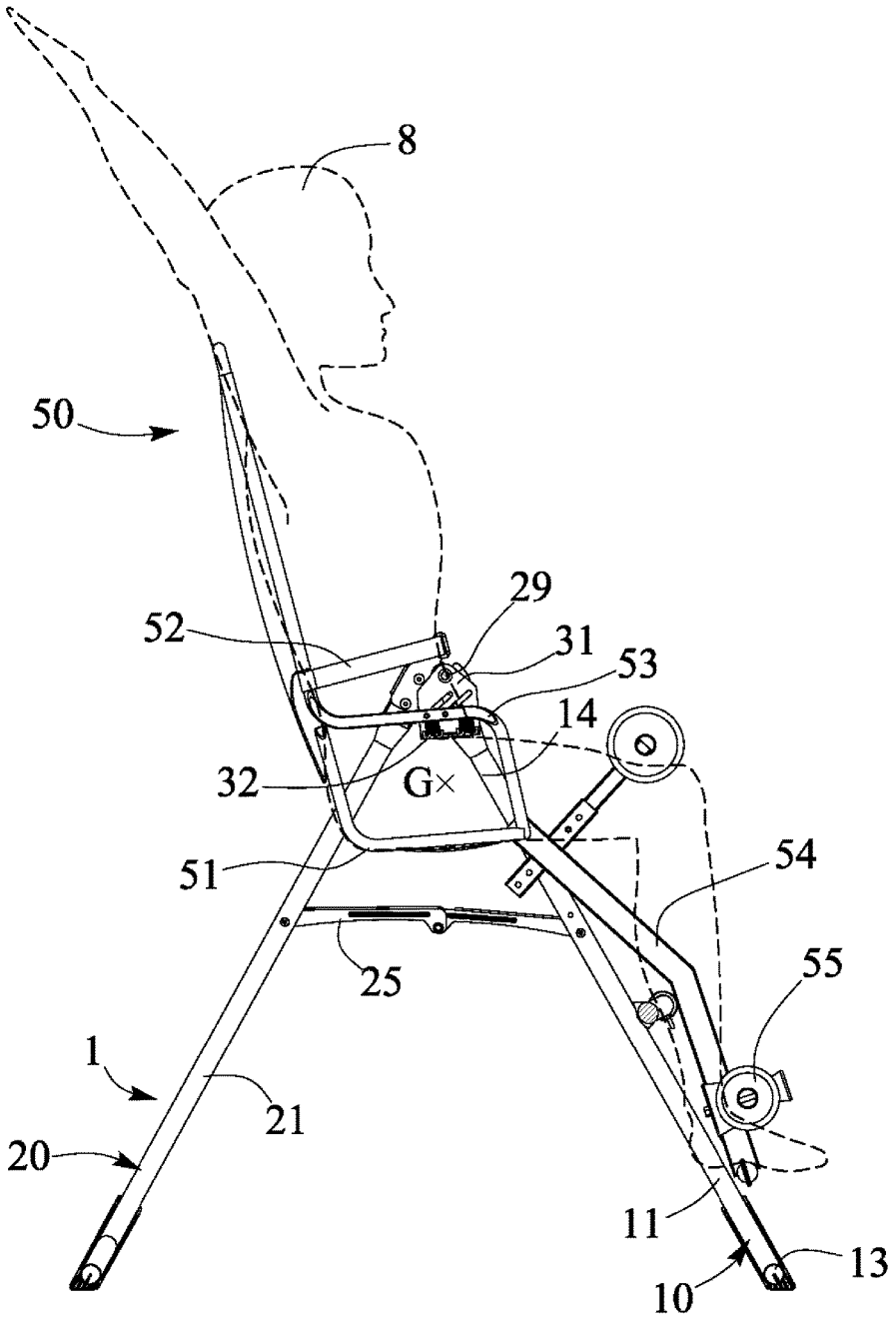
FIGS. 4, 5, 6 are side plan schematic views similar to FIG. 3, illustrating the operation of the tilting inversion exerciser.
Figure 8:
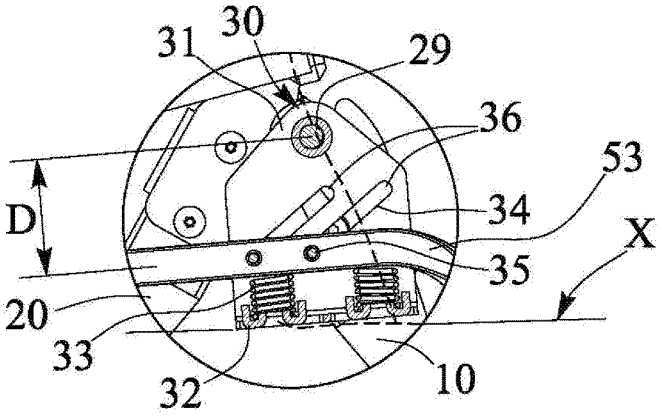

As shown in FIGS. 4 and 8, when a relatively heavier user 8 is seated on the seat member 51 of the supporting table 50, the spring biasing members 33 may be fully or completely depressed by the arm rests 53 of the seat member 51 of the supporting table 50, and the followers 35 may be moved and engaged with the other or second end portion 37 of the grooves 34 of the carrier 30. At this moment, the arm rests 53 of the seat member 51 of the supporting table 50 and the followers 35 are moved further away from the apex member 29 at a predetermined distance (D) which is greater than the distance (d) formed between the arm rests 53 or the followers 35 and the apex member 29 as that shown in FIGS. 6 and 9, when the relatively light weight user 8 is seated on the seat member 51 of the supporting table 50.

Figure 5:
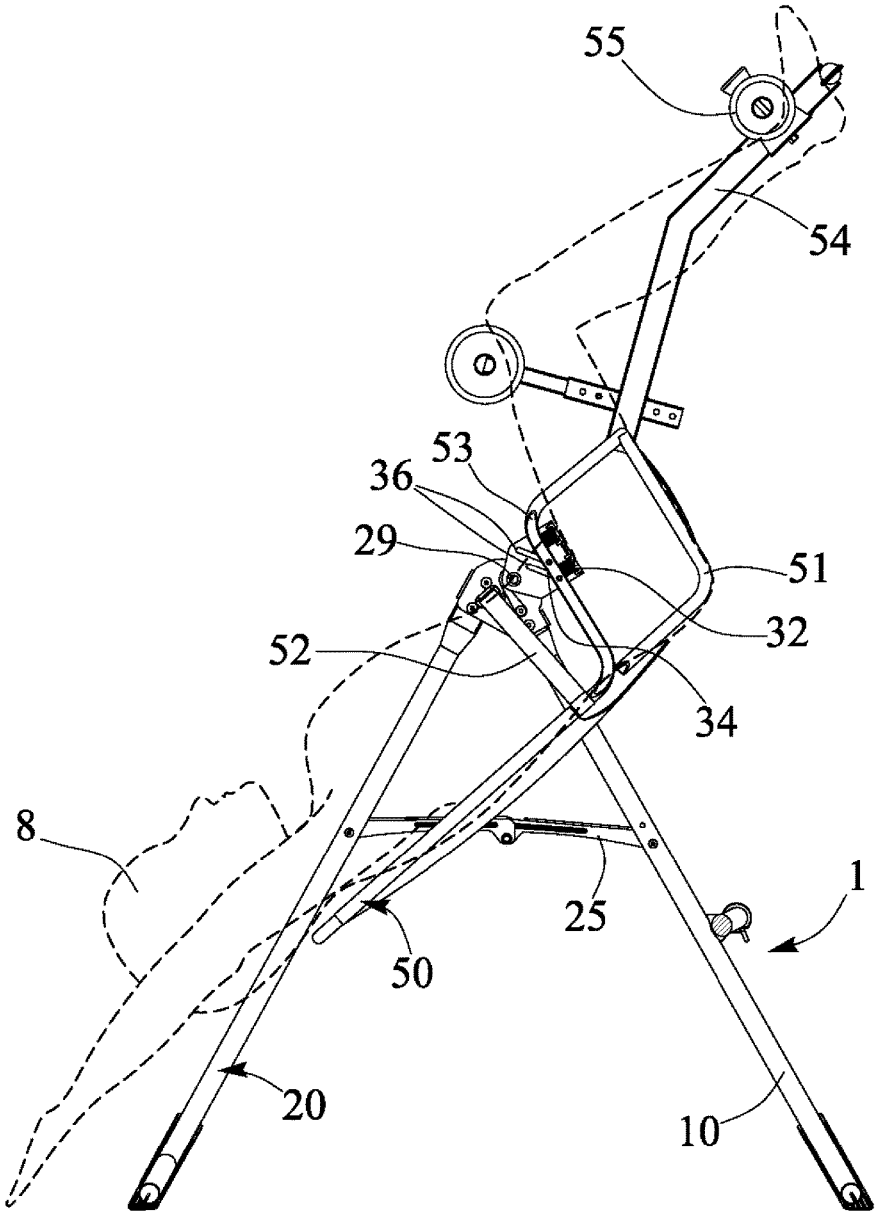

As also shown in FIGS. 4 and 8, when the relatively heavier user 8 is seated on the seat member 51 of the supporting table 50, the center of gravity (G) of the heavier user 8 and the seat member 51 of the supporting table 50 may be relatively and slightly lowered then that shown in FIGS. 6 and 9, when the relatively light weight user 8 is seated on the seat member 51 of the supporting table 50, for giving some security to the user while conducting the inversion exercises. As shown in FIG. 5, when the user 8 is conducting the inversion exercises and moved toward an inverted operating position, it is preferable that the one or first end portion 36 of the grooves 34 of the carrier 30 is arranged and still located higher than the other or second end portion 37 of the grooves 34 of the carrier 30, such that the followers 35 of the arm rests 53 of the seat member 51 of the supporting table 50 may still be solidly and stably maintained and positioned within the other or second end portion 37 of the grooves 34 of the carrier 30.

Alternatively, as shown in FIGS. 10-18, the lower supporting stand 1 may include a single carrier 301 pivotally or rotatably attached or mounted or secured or coupled to the supporting stand 1, the carrier 301 includes two limbs or brackets 38 pivotally or rotatably attached or mounted or secured or coupled to the upper portions 14 of the side posts 11, 12 of the primary frame 10 or the upper portions 24 of the posts 21, 22 of the rear frame 20 respectively of the supporting stand 1 with the apex members 29 for engaging with and for attaching or mounting or securing or supporting the supporting table 50 to the supporting stand 1, and also includes one or more, such as two oblong holes or grooves 34 formed therein and slidably receiving or engaging with the guiding pins or followers 35 respectively and for guiding and limiting the followers 35 and thus the seat member 51 of the supporting table 50 to move or slide relative to the carrier 301 and/or the supporting stand 1.

One or more spring biasing members 33 may be disposed or attached or mounted or secured to the flap 32 of the carrier 301 and contacted or engaged with the seat member 51 of the supporting table 50, and are thus engaged between the carrier 301 and the seat member 51 of the supporting table 50 for applying a spring biasing force between the supporting table 50 and the carrier 301 and/or the supporting stand 1 and thus for balancing the supporting table 50 relative to the carrier 301 and/or the supporting stand 1, and thus for allowing the center of gravity (G) of the user 8 and the seat member 51 of the supporting table 50 and/or the followers 35 to be relatively and slightly adjusted relative to the apex member 29. The sliding engagement of the followers 35 with the grooves 34 of the carrier 30 may thus be formed and provided as a guiding mechanism or device 34, 35 for guiding the seat member 51 of the supporting table 50 to move relative to the follower 35 and/or the carrier 30.

Accordingly, the tilting inversion exerciser in accordance with the present invention includes an adjustable structure or configuration for adjusting the user supporting table to a suitable or selected position relative to the lower or base support or supporting stand automatically and for suitably and safely supporting the user and for giving some security to the user while conducting the inversion exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion exerciser comprising:

a supporting stand including a primary frame and an auxiliary frame pivotally coupled together to form an inverted V-shaped structure, a carrier pivotally attached to said supporting stand with an apex member, a supporting table attached to said carrier and movable relative to said carrier, said carrier including a guiding device for guiding said supporting table to move relative to said carrier and said apex member, and said guiding device of said carrier including at least one groove formed in said guiding device, and said at least one groove of said carrier including a first end portion located closer to said apex member than a second end portion of said at least one groove of said carrier, said supporting table including at least one follower slidably engaged with said at least one groove of said carrier for guiding and limiting said at least one follower and said supporting table to move relative to said carrier and said supporting stand, and a spring biasing member engaged between said carrier and said supporting table for adjusting a center of gravity of said carrier relative to said supporting table when users of different weight is engaged onto said supporting table.

2. The tilting inversion exerciser as claimed in claim 1, wherein said at least one groove of said carrier is inclined relative to a base axis of said carrier, said at least one groove of said carrier is offset from said apex member for a predetermined distance and is tangent to said apex member.

3. The tilting inversion exerciser as claimed in claim 1, wherein said supporting table includes an arm rest engaged with said spring biasing member, and said at least one follower is attached to said arm rest.

4. The tilting inversion exerciser as claimed in claim 1, wherein said carrier includes a flap extended from a bracket for supporting said spring biasing member.

5. The tilting inversion exerciser as claimed in claim 1, wherein said primary frame and said auxiliary frame of said supporting table are pivotally coupled together with said apex member.

* * * * *